US009732580B2

(12) United States Patent
Krueger et al.

(10) Patent No.: US 9,732,580 B2
(45) Date of Patent: Aug. 15, 2017

(54) SELF-BOOSTING EXPANDABLE SEAL WITH CANTILEVERED SEAL ARM

(71) Applicants: Matthew J. Krueger, Houston, TX (US); Charles Michael Meador, Cypress, TX (US)

(72) Inventors: Matthew J. Krueger, Houston, TX (US); Charles Michael Meador, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 456 days.

(21) Appl. No.: 14/445,691

(22) Filed: Jul. 29, 2014

(65) Prior Publication Data

US 2016/0032680 A1 Feb. 4, 2016

(51) Int. Cl.

| | |
|---|---|
| ***E21B 23/06*** | (2006.01) |
| ***E21B 33/03*** | (2006.01) |
| ***E21B 33/124*** | (2006.01) |
| ***E21B 33/128*** | (2006.01) |
| ***E21B 33/12*** | (2006.01) |
| *E21B 33/00* | (2006.01) |

(52) U.S. Cl.
CPC .... *E21B 33/1208* (2013.01); *E21B 2033/005* (2013.01)

(58) Field of Classification Search
CPC ..... E21B 33/1208; E21B 2033/005; E21B 33/10; E21B 33/1216; E21B 33/128; E21B 23/06; E21B 33/1295
See application file for complete search history.

(56) References Cited

U.S. PATENT DOCUMENTS

| | | | | |
|---|---|---|---|---|
| 4,702,481 | A * | 10/1987 | Brammer | E21B 33/04 277/328 |
| 5,105,879 | A | 4/1992 | Ross | |
| 5,355,961 | A | 10/1994 | Gariepy et al. | |
| 5,511,620 | A | 4/1996 | Baugh et al. | |
| 6,666,276 | B1 | 12/2003 | Yokley et al. | |
| 6,705,615 | B2 | 3/2004 | Milberger et al. | |
| 6,962,206 | B2 | 11/2005 | Hirth et al. | |
| 7,748,467 | B2 * | 7/2010 | Doane | E21B 33/1208 166/134 |

(Continued)

FOREIGN PATENT DOCUMENTS

EP 0127560 A2 12/1984

OTHER PUBLICATIONS

International Search Report and Written Opinion of the International Search Authority issued in related PCT Application No. PCT/US2015/036864 dated Sep. 1, 2015, 8 pages.

*Primary Examiner* — Daniel P Stephenson
(74) *Attorney, Agent, or Firm* — Cantor Colburn LLP

(57) ABSTRACT

A downhole seal assembly includes a body extending from an uphole end to a downhole end. The body includes a first sealing surface and an opposing, second sealing surface that is angled relative to the first sealing surface. A first void is formed in the second sealing surface adjacent the uphole end, and a seal is arranged in the first void. A second void is formed in the second sealing surface adjacent the downhole end. One or more passages is formed in the downhole end and fluidically coupled to the second void. The one or more passages is configured and disposed to guide downhole fluids into the second void forcing the first sealing surface against a wellbore.

26 Claims, 7 Drawing Sheets

(56) References Cited

U.S. PATENT DOCUMENTS

| | | | | |
|---|---|---|---|---|
| 7,784,797 | B2 * | 8/2010 | Baugh | E21B 23/01 166/208 |
| 7,905,492 | B2 | 3/2011 | Doane | |
| 8,973,921 | B2 * | 3/2015 | Doane | F16J 15/025 166/182 |
| 8,997,882 | B2 * | 4/2015 | Turley | E21B 33/1216 166/208 |
| 9,260,926 | B2 * | 2/2016 | Givens | E21B 17/08 |
| 9,556,700 | B2 * | 1/2017 | Shek | E21B 33/10 |
| 2006/0260820 | A1 | 11/2006 | Whitsitt et al. | |
| 2007/0125532 | A1 | 6/2007 | Murray et al. | |
| 2012/0205873 | A1 * | 8/2012 | Turley | E21B 33/1216 277/336 |
| 2015/0308214 | A1 * | 10/2015 | Bilansky | E21B 33/1216 166/387 |
| 2016/0032680 | A1 * | 2/2016 | Krueger | E21B 33/1208 166/191 |

* cited by examiner

SELF-BOOSTING EXPANDABLE SEAL WITH CANTILEVERED SEAL ARM

BACKGROUND

Hydrocarbon recovery tools employ a variety of seals and anchoring arrangements. Seals are arranged between tools and a wellbore as well as between various tool components. Different seals are used for various conditions encountered in a downhole environment.

SUMMARY

A downhole seal assembly includes a body extending from an uphole end to a downhole end. The body includes a first sealing surface and an opposing, second sealing surface that is angled relative to the first sealing surface. A first void is formed in the second sealing surface adjacent the uphole end, and a seal is arranged in the first void. A second void is formed in the second sealing surface adjacent the downhole end. One or more passages is formed in the downhole end and fluidically coupled to the second void. The one or more passages is configured and disposed to guide downhole fluids into the second void forcing the first sealing surface against a wellbore.

A downhole seal system includes a tubular component, and a component having an outer surface arranged radially inwardly of the tubular component. At least a portion of the outer surface is a frusto-conical surface. A downhole seal assembly is arranged between the tubular component and the component. The downhole seal assembly includes a body extending from an uphole end to a downhole end. The body includes a first sealing surface and an opposing second sealing surface that is angled relative to the first sealing surface. A first void is formed in the second sealing surface adjacent the uphole end, and a seal is arranged in the first void. A second void is formed in the second sealing surface adjacent the downhole end. One or more passages is formed in the downhole end and fluidically coupled to the second void. The one or more passages is configured and disposed to guide downhole fluids into the second void forcing the first sealing surface against a wellbore.

A resource capture system includes an uphole system having at least one wellhead, and a downhole system including a tubular component, and a component having an outer surface arranged radially inwardly of the tubular component. At least a portion of the outer surface is a frusto-conical surface. A downhole seal assembly is arranged between the tubular component and the component. The downhole seal assembly includes a body extending from an uphole end to a downhole end. The body includes a first sealing surface and an opposing, second sealing surface that is angled relative to the first sealing surface. A first void is formed in the second sealing surface adjacent the uphole end, and a seal is arranged in the first void. A second void is formed in the second sealing surface adjacent the downhole end. One or more passages is formed in the downhole end and fluidically coupled to the second void. The one or more passages is configured and disposed to guide downhole fluids into the second void forcing the first sealing surface against a wellbore.

BRIEF DESCRIPTION OF THE DRAWINGS

Referring now to the drawings wherein like elements are numbered alike in the several Figures.

DETAILED DESCRIPTION

Figure 1:
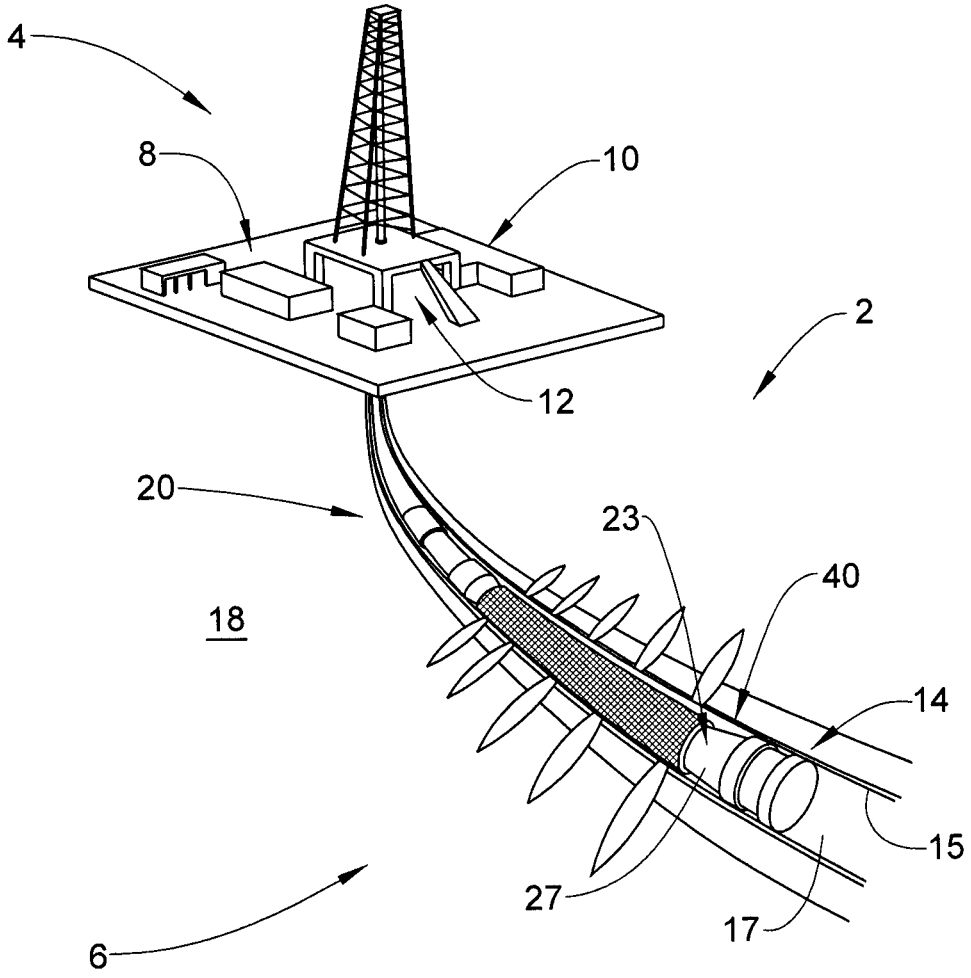
FIG. 1 depicts a resource extraction system including a downhole seal system having a downhole seal assembly, in accordance with an exemplary embodiment.

A resource extraction system, in accordance with an exemplary embodiment, is indicated generally at 2, in FIG. 1. Resource extraction system 2 includes an uphole system 4 operatively connected to a downhole system 6. Uphole system 4 may include pumps 8 that aid in completion and/or extraction processes as well as fluid storage 10. Fluid storage 10 may contain a completion fluid that is introduced into downhole system 6. Uphole system 4 may also include one or more wellheads 12. Downhole system 6 may include a tubular component 14, shown in the form of a casing 15 that extends into a wellbore 17 formed in a formation 18. A downhole string 20 extends into wellbore 17. Downhole string 20 may include a number of connected components and/or tools 23. In the exemplary embodiment shown, component 23 includes a frusto-conical surface 27.

Figure 2:
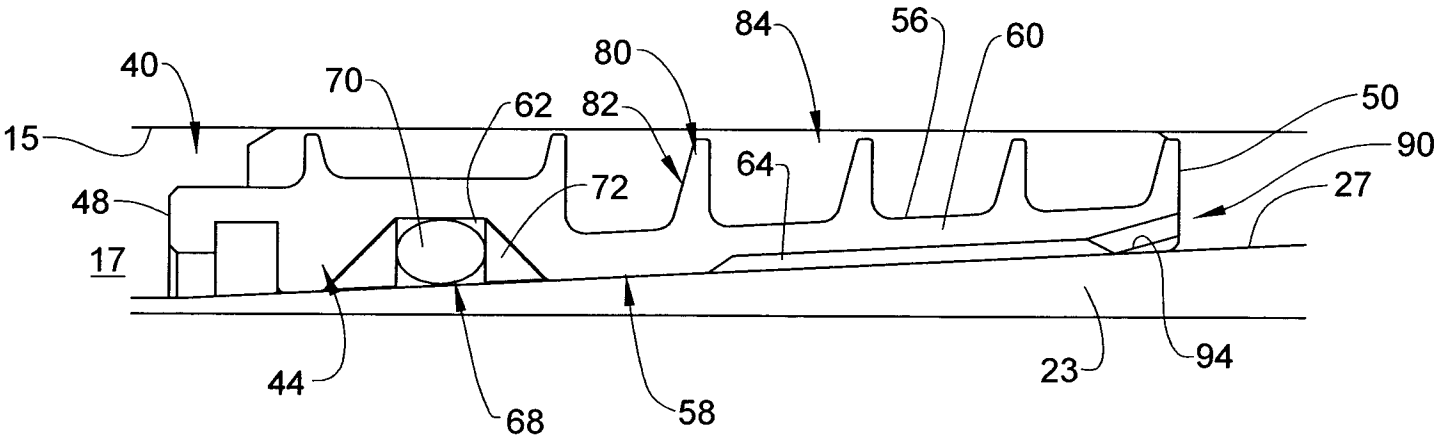
FIG. 2 is a partial cross-sectional side view of a downhole seal assembly, in accordance with an aspect of an exemplary embodiment.
Figure 3:
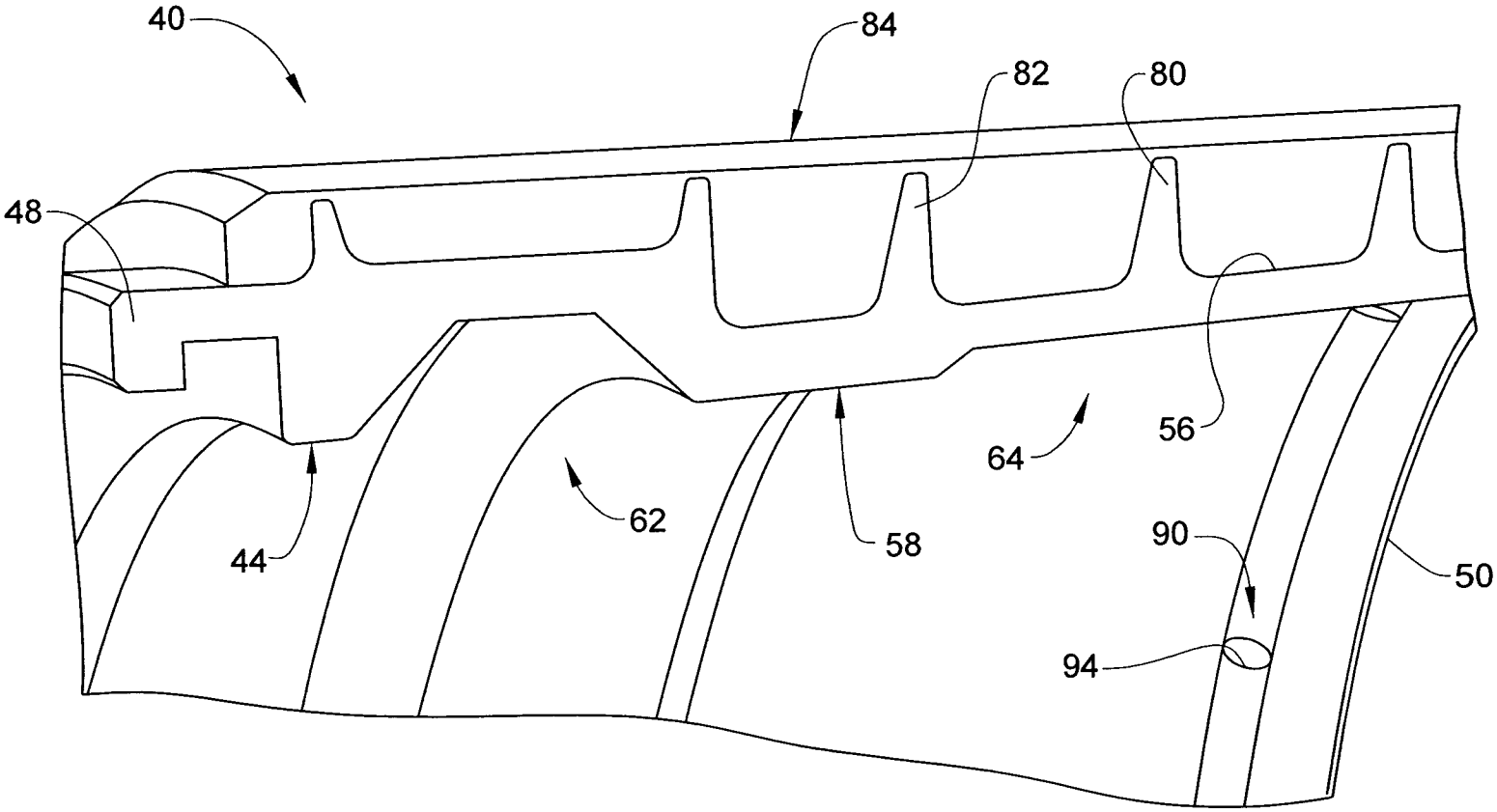
FIG. 3 is a partial perspective view of the downhole seal assembly of FIG. 2.

In accordance with an exemplary embodiment, downhole string 20 includes a seal assembly 40 that may be arranged between component 23 and casing 15. As shown in FIGS. 2 and 3, seal assembly 40 includes a body 44 that extends from an uphole end 48 to a downhole end 50. Body 44 also includes a first sealing surface 56 and a second sealing surface 58. First sealing surface 56 faces casing 15 and second sealing surface 58 faces frusto-conical surface 27 of component 23. A cantilevered arm 60 extends from second sealing surface 58 to downhole end 50. A first void 62 is formed in second sealing surface 58 adjacent to uphole end 48, and a second void 64 is formed in second sealing surface 58 adjacent to downhole end 50. A seal 68 is arranged in first void 62. Seal 68 may take the form of an O-ring 70 that may be supported by a back-up ring 72. A plurality of ribs 80 may extend from first sealing surface 56. Ribs 80 define a plurality of seal pockets 82. Another seal 84 is arranged in seal pockets 82. Of course, it should be understood, that more than one seal may be arranged in seal pockets 82.

Seal assembly 40 seals between casing 15 and component 23. A setting tool (not shown) may be employed to urge seal assembly 40 along component 23 forcing seal 84 against casing 15 and seal 68 against frusto-conical surface 27. Seal assembly 40 is initially in an un-expanded condition when run downhole. That is, seal assembly 40 may have an initial diameter that is smaller than a final, sealing diameter for conveyance downhole. As such, seal assembly 40 may be considered as an expandable component. Once in a desired position, a setting tool (not shown) causes seal assembly 40 to expand. In accordance with an aspect of an exemplary embodiment, the setting tool shifts seal assembly 40 along frusto-conical surface 27 causing an expansion from the initial diameter to a larger diameter. Expansion may continue until seal assembly 40 contacts casing 15. More specifically, the setting tool urges seal assembly 40 along frusto-conical surface 27 causing seal 68 and seal 84 to move against respective ones of component 23 and casing 15. When the setting tool is removed, pressure from uphole fluids (not shown) shifts seal assembly 40 along frusto-conical surface 27 to enhance sealing. In this manner, seal assembly 40 prevents downhole fluid from moving between component 23 and casing 15. Of course, it should be understood that seal assembly 40 may be arranged between any two or more components of downhole string 20 and need not be limited to sealing between component 23 and casing 15.

In further accordance with an exemplary embodiment, seal assembly 40 includes a plurality of passages 90 formed in downhole end 50. Passages 90 extend from downhole end 50 to second void 64. Passages 90 are shown in the form of conduits 94 having a circular cross-section and fluidically connect wellbore 17 downhole of seal assembly 40 and second void 64. In this manner, downhole fluids (not shown) pass through conduits 94 and enter second void 64. As the downhole fluids are under pressure, a force is exerted on cantilevered arm 60 urging seal 84 against casing 15 to further enhance sealing.

Figure 4:
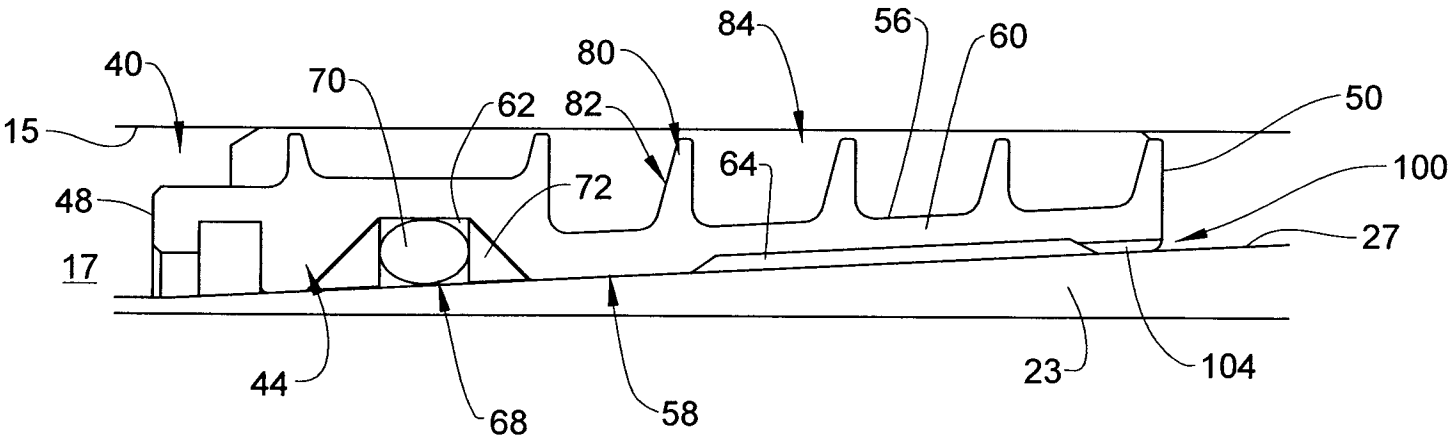
FIG. 4 is a partial cross-sectional side view of a downhole seal assembly, in accordance with another aspect of an exemplary embodiment.
Figure 5:
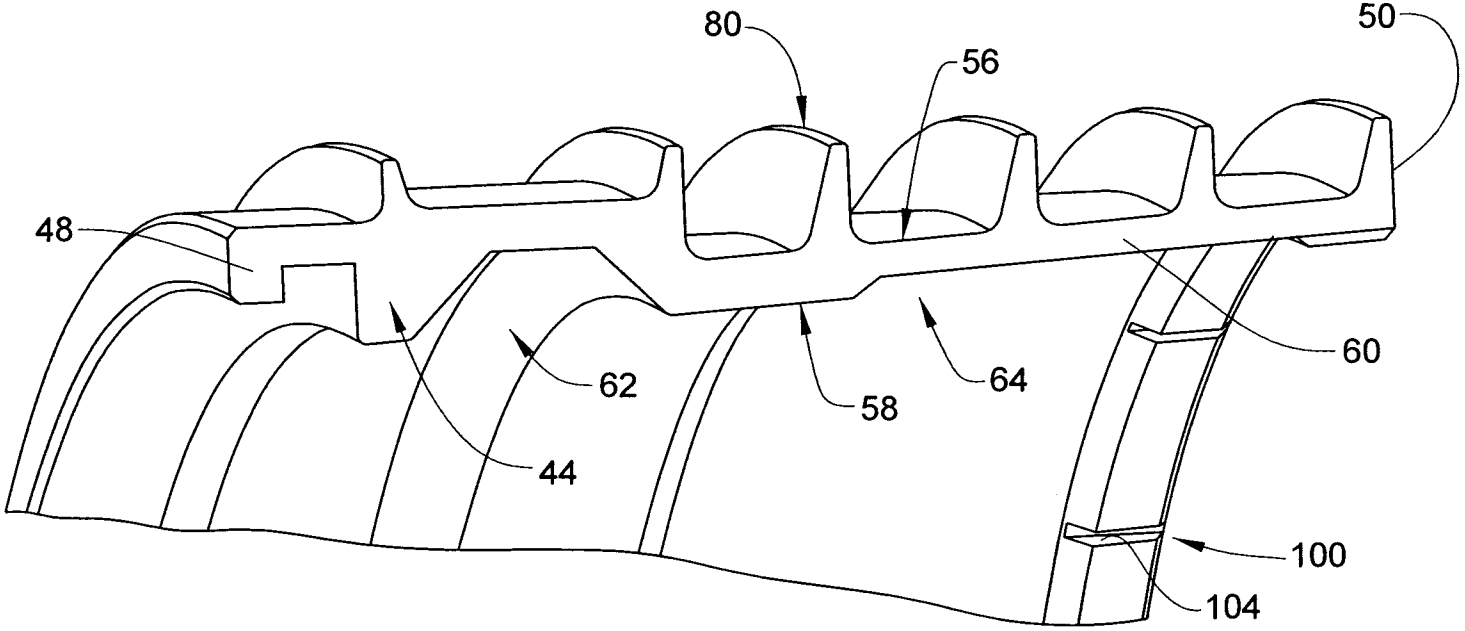
FIG. 5 is a partial perspective view of the downhole seal assembly of FIG. 4.

Reference will now follow to FIGS. 4 and 5, wherein like reference numbers represent corresponding parts in the respective views in describing a plurality of passages 100 formed in downhole end 50, in accordance with another aspect of an exemplary embodiment. Passages 100 are shown in the form of slots 104 formed in second sealing surface 58 at downhole end 50. Slots 104 fluidically connect second void 64 and wellbore 17 downhole of seal assembly 40. Slots 104 include a non-circular cross-section. In accordance with the exemplary aspect shown, slots 104 include a generally rectangular cross-section. It should however be understood that slots 104 may take on a variety of geometries, including circular, semi-circular, trapezoidal, and the like. In a manner similar to that described above, downhole fluids pass through slots 104 and enter second void 64. As the downhole fluids are under pressure, a force is exerted on body 44 at second sealing surface 58 urging seal 84 against casing 15 to further enhance sealing.

Figure 6:
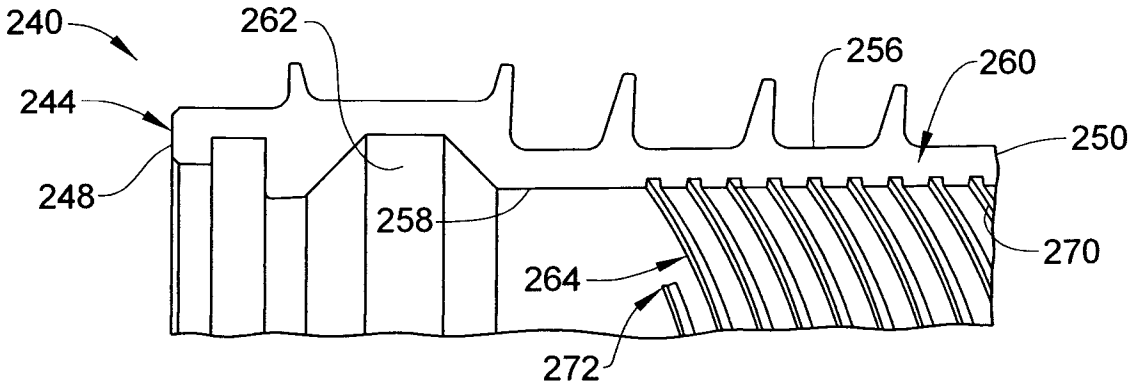
FIG. 6 is a partial cross-sectional view of a downhole seal assembly in accordance with yet another aspect of an exemplary embodiment.

FIG. 6 illustrates a seal assembly 240 in accordance with another aspect of an exemplary embodiment. Seal assembly 240 includes a body 244 that extends from an uphole end 248 to a downhole end 250. Body 244 also includes a first sealing surface 256 and a second sealing surface 258. First sealing surface 256 faces casing 15 and second sealing surface 258 faces frusto-conical surface 27 of component 23. A cantilevered arm 260 extends from second sealing surface 258 to downhole end 50. A first void 262 is formed in second sealing surface 258 adjacent to uphole end 48.

Figure 7:
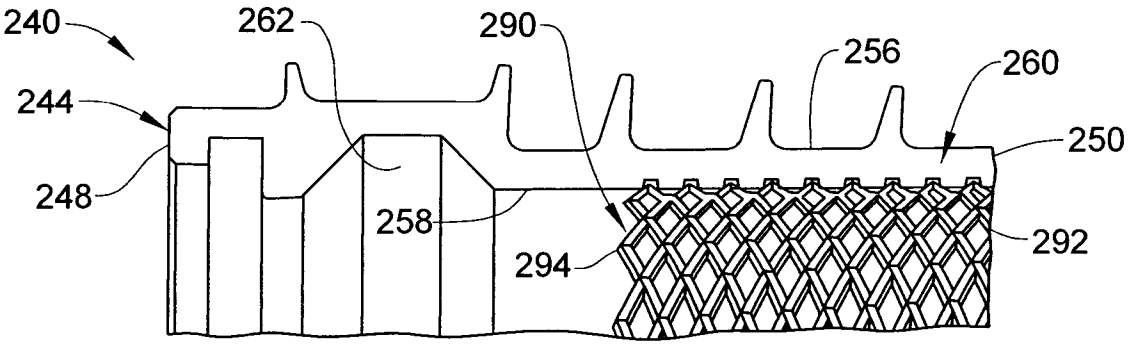
FIG. 7 is a partial cross-sectional view of the downhole seal assembly of FIG. 6 in accordance with still yet another aspect of an exemplary embodiment.

In accordance with one aspect of an exemplary embodiment, first void 262 shown in the form of a thread or spiraling groove 264 is formed in second sealing surface 258. Spiraling groove 264 extends from a first, lead-in end 270 exposed to downhole pressure to a second end 272. Downhole pressure enters into lead-in end 270 and moves along spiraling groove 264 toward second end 272 urging cantilevered arm 260 against casing 15. In accordance with yet another aspect of an exemplary embodiment illustrated in FIG. 7, wherein like reference numbers represent corresponding parts in the respective views, second sealing surface 258 may be provided with a plurality of second voids shown in the form of threads or spiraling grooves, one of which is indicated at 290. Each spiraling groove 290 extends from a first or lead-in end 292 to a second end 294. Spiraling groove 290 may extend across second sealing surface 258 in a single direction, or may crisscross across second sealing surface 258, as shown in FIG. 7.

At this point it should be understood that the exemplary embodiment describe a self-boosting seal assembly that is urged into sealing engagement by uphole and downhole fluid pressure. Axial pressure from downhole fluids passes into a void formed in the seal generating a radial force. The radial force urges a cantilevered arm of the seal assembly against a tubular component to boost sealing efficacy.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole seal assembly comprising:

a body extending from an uphole end to a downhole end, the body including a first sealing surface and an opposing, second sealing surface that is angled relative to the first sealing surface;

a first void formed in the second sealing surface adjacent the uphole end;

a seal arranged in the first void;

a second void formed in the second sealing surface adjacent the downhole end; and one or more passages fluidically coupled to the second void formed in the downhole end, the one or more passages being configured and disposed to guide downhole fluids into the second void forcing the first sealing surface against a wellbore.

2. The downhole seal assembly according to claim 1, wherein the one or more passages comprise one or more slots formed in the second sealing surface at the downhole end.

3. The downhole seal assembly according to claim 2, wherein the one or more slots include a generally rectangular cross-section.

4. The downhole seal assembly according to claim 1, wherein the one or more passages comprise one or more conduits passing through the downhole end.

5. The downhole seal assembly according to claim 4, wherein the one or more conduits include a generally circular cross-section.

6. The downhole seal assembly according to claim 1, further comprising: at least one backup ring arranged in the first void adjacent the seal.

7. The downhole seal assembly according to claim 1, wherein the seal comprises an O-ring.

8. The downhole seal assembly according to claim 1, further comprising: another seal arranged at the first sealing surface.

9. The downhole seal assembly according to claim 8, further comprising: one or more ribs projecting from the first sealing surface, the one or more ribs forming a plurality of seal pockets.

10. The downhole seal assembly according to claim 1, further comprising: a cantilevered arm extending between the second sealing surface and the downhole end, the cantilevered arm being configured and disposed to move radially outwardly when exposed to downhole fluids in the second void.

11. The downhole seal assembly according to claim 1, wherein the second void comprises at least one spiraling groove formed in the second sealing surface.

12. The downhole assembly according to claim 11, wherein the at least one passage comprises a lead-in end of the at least one spiraling groove.

13. A downhole system comprising:

a tubular component;

a component having an outer surface arranged radially inwardly of the tubular component, at least a portion of the outer surface being a frusto-conical surface; and a downhole seal assembly arranged between the tubular component and the component, the downhole seal assembly comprising:

a body extending from an uphole end to a downhole end, the body including a first sealing surface and an opposing, second sealing surface that is angled relative to the first sealing surface;

a first void formed in the second sealing surface adjacent the uphole end;

a seal arranged in the first void;

a second void formed in the second sealing surface adjacent the downhole end; and one or more passages fluidically coupled to the second void formed in the downhole end, the one or more passages being configured and disposed to guide downhole fluids into the second void forcing the first sealing surface against a wellbore.

14. The downhole system according to claim 13, wherein the one or more passages comprise one or more slots formed in the second sealing surface at the downhole end.

15. The downhole system according to claim 14, wherein the one or more slots include a generally rectangular cross-section.

16. The downhole system according to claim 13, wherein the one or more passages comprise one or more conduits passing through the downhole end.

17. The downhole system according to claim 13 further comprising: a cantilevered arm extending between the second sealing surface and the downhole end, the cantilevered arm being configured and disposed to move radially outwardly when exposed to downhole fluids in the second void.

18. The downhole system according to claim 13, wherein the second void comprises at least one spiraling groove formed in the second sealing surface.

19. The downhole system according to claim 18, wherein the at least one passage comprises a lead-in end of the at least one spiraling groove.

20. A resource capture system comprising:

an uphole system including at least one wellhead; and a downhole system including a tubular component, a component having an outer surface arranged radially inwardly of the tubular component, at least a portion of the outer surface being a frusto-conical surface, and a downhole seal assembly arranged between the tubular component and the component, the downhole seal assembly comprising:

a body extending from an uphole end to a downhole end, the body including a first sealing surface and an opposing, second sealing surface that is angled relative to the first sealing surface;

a first void formed in the second sealing surface adjacent the uphole end;

a seal arranged in the first void;

a second void formed in the second sealing surface adjacent the downhole end; and one or more passages fluidically coupled to the second void formed in the downhole end, the one or more passages being configured and disposed to guide downhole fluids into the second void forcing the first sealing surface against a wellbore.

21. The resource capture system according to claim 20, wherein the one or more passages comprise one or more slots formed in the second sealing surface at the downhole end.

22. The resource capture system according to claim 21, wherein the one or more slots include a generally rectangular cross-section.

23. The resource capture system according to claim 20, wherein the one or more passages comprise one or more conduits passing through the downhole end.

24. The resource capture system according to claim 20, further comprising: a cantilevered arm extending between the second sealing surface and the downhole end, the cantilevered arm being configured and disposed to move radially outwardly when exposed to downhole fluids in the second void.

25. The resource capture system according to claim 20, wherein the second void comprises at least one spiraling groove formed in the second sealing surface.

26. The resource capture system according to claim 25, wherein the at least one passage comprises a lead-in end of the at least one spiraling groove.

* * * * *